US010739716B2

(12) United States Patent
Kiriyama

(10) Patent No.: US 10,739,716 B2
(45) Date of Patent: Aug. 11, 2020

(54) IMAGE FORMING APPARATUS, IMAGE FORMING SYSTEM AND COMPUTER READABLE RECORDING MEDIUM

(71) Applicant: Konica Minolta, Inc., Chiyoda-ku, Tokyo (JP)

(72) Inventor: Tomohiro Kiriyama, Kofu (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 274 days.

(21) Appl. No.: 15/729,969

(22) Filed: Oct. 11, 2017

(65) Prior Publication Data

US 2018/0120751 A1 May 3, 2018

(30) Foreign Application Priority Data

Oct. 28, 2016 (JP) ..... 2016-211445

(51) Int. Cl.
*G03G 15/00* (2006.01)
*G03G 15/23* (2006.01)

(52) U.S. Cl.
CPC ..... *G03G 15/6567* (2013.01); *G03G 15/234* (2013.01); *G03G 15/6544* (2013.01); *G03G 2215/00936* (2013.01); *G03G 2221/1696* (2013.01)

(58) Field of Classification Search
CPC ..... G03G 15/6567; G03G 15/234; G03G 15/6544; G03G 2215/00936; G03G 2221/1696
See application file for complete search history.

(56) References Cited

U.S. PATENT DOCUMENTS

2012/0141147 A1* 6/2012 Furuya ..... G03G 15/6529 399/16
2015/0193492 A1* 7/2015 Gunaratne ..... G06F 16/23 707/609
2016/0054954 A1 2/2016 Iizuka et al.
(Continued)

FOREIGN PATENT DOCUMENTS

CN 1932660 A 3/2007
CN 105933572 A 9/2016
(Continued)

OTHER PUBLICATIONS

Office Action dated Jun. 20, 2019, by the Chinese Patent Office in corresponding Chinese Patent Application No. 01710996397.8 and English translation of the Office Action. (18 pages).
(Continued)

*Primary Examiner* — David H Banh
(74) *Attorney, Agent, or Firm* — Buchanan Ingersoll & Rooney PC

(57) ABSTRACT

An image forming apparatus includes: an image former which forms one or more images on at least one sheet fed from each of a plurality of feed trays; a first adjuster which adjusts positions of the images formed on the sheet by the image former such that the positions of the images match on both sides of the sheet fed from each of the feed trays; and a second adjuster which further adjusts the positions of the images on the sheet, the positions having been adjusted by the first adjuster, such that the positions of the images match between the sheets fed from the feed trays.

11 Claims, 15 Drawing Sheets

(56) References Cited

U.S. PATENT DOCUMENTS

| | | | | |
|---|---|---|---|---|
| 2016/0255232 | A1 | 9/2016 | Ooishi | |
| 2017/0038718 | A1* | 2/2017 | Tajiri | G03G 15/6591 |
| 2017/0153586 | A1* | 6/2017 | Tanaka | G03G 15/5062 |

FOREIGN PATENT DOCUMENTS

| | | | |
|---|---|---|---|
| JP | 2002-337433 | A | 11/2002 |
| JP | 2005-283675 | A | 10/2005 |
| JP | 2006-011285 | A | 1/2006 |
| JP | 2018-66815 | A | 4/2018 |

OTHER PUBLICATIONS

Office Action dated Feb. 12, 2019, by the Chinese Patent Office in corresponding Chinese Patent Application No. 201710996397.8 and English translation of the Office Action. (20 pages).
Office Action dated Sep. 11, 2019, by the Chinese Patent Office in corresponding Chinese Patent Application No. 201710996397.8 and English translation of the Office Action. (20 pages).
Notice of Reasons for Refusal dated Jun. 16, 2020, by the Japanese Patent Office in corresponding Japanese Patent Application No. 2016-211445 and an English translation of the Notice. (10 pages).

* cited by examiner

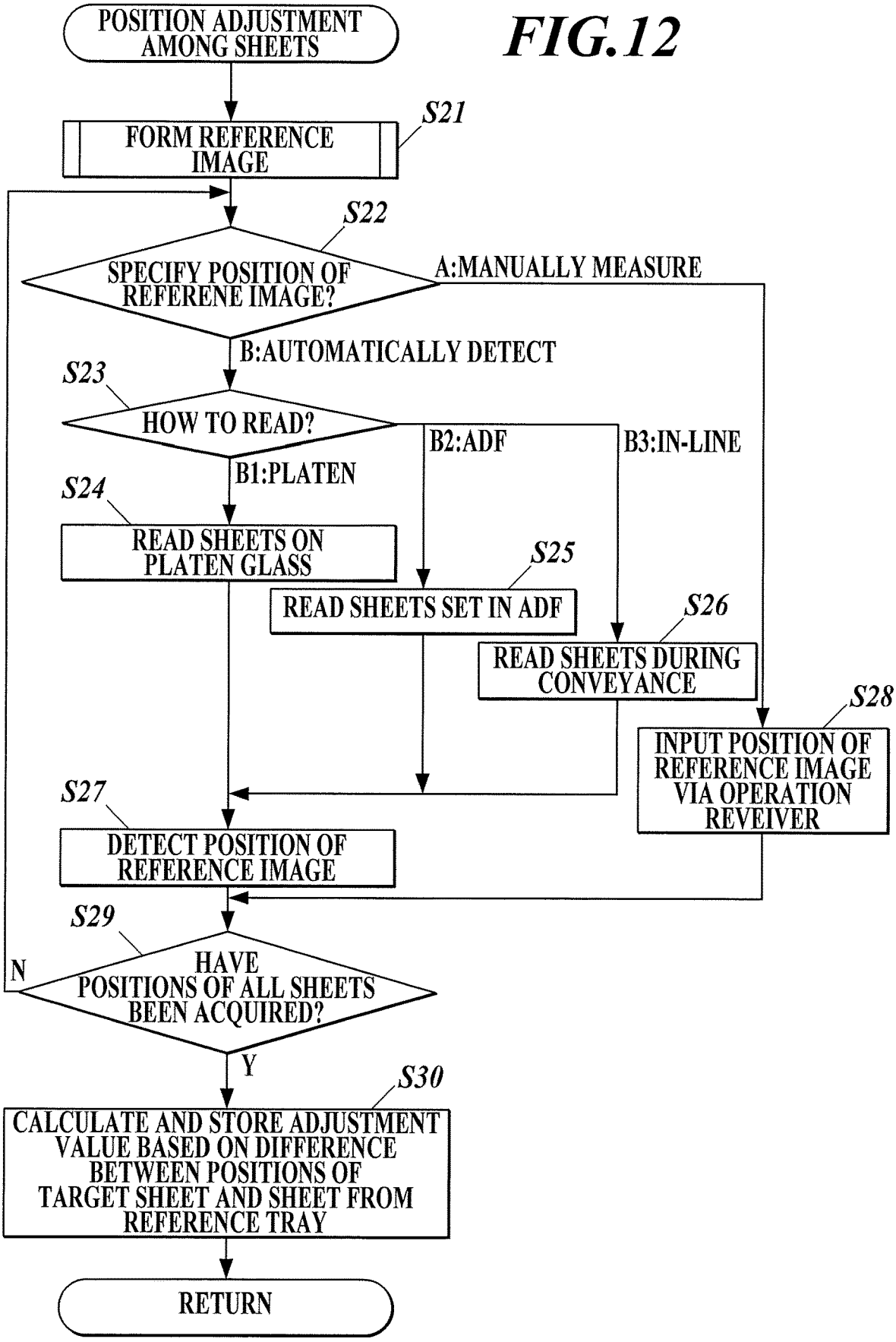
FIG.12
POSITION ADJUSTMENT AMONG SHEETS
S21
FORM REFERENCE IMAGE
S22
SPECIFY POSITION OF REFERENE IMAGE?
A:MANUALLY MEASURE
B:AUTOMATICALLY DETECT
S23
HOW TO READ?
B2:ADF
B3:IN-LINE
B1:PLATEN
S24
READ SHEETS ON PLATEN GLASS
S25
READ SHEETS SET IN ADF
S26
READ SHEETS DURING CONVEYANCE
S28
INPUT POSITION OF REFERENCE IMAGE VIA OPERATION REVEIVER
S27
DETECT POSITION OF REFERENCE IMAGE
S29
HAVE POSITIONS OF ALL SHEETS BEEN ACQUIRED?
N
Y
S30
CALCULATE AND STORE ADJUSTMENT VALUE BASED ON DIFFERENCE BETWEEN POSITIONS OF TARGET SHEET AND SHEET FROM REFERENCE TRAY
RETURN

IMAGE FORMING APPARATUS, IMAGE FORMING SYSTEM AND COMPUTER READABLE RECORDING MEDIUM

CROSS-REFERENCE TO RELATED APPLICATIONS

The present U. S. patent application claims a priority under the Paris Convention of Japanese Patent Application No. 2016-211445 filed on Oct. 28, 2016, the entirety of which is incorporated herein by references.

BACKGROUND

Technological Field

The present invention relates to an image forming apparatus, an image forming system, and a computer readable recording medium.

Description of the Related Art

There is a known image forming apparatus such as a copying machine and a printer having a booklet create mode for forming images on both sides of a sheet such that a booklet can be created by stacking and binding sheets on which the images are formed. Some image forming apparatuses can create one booklet by use of a plurality of types of sheets, for example, cardboard and high-quality paper can be used for a front cover and the text of the booklet, respectively.

When the images are formed on both sides of the sheet, the sheet may contract or expand due to fixing processing, which may cause positional deviation between the images on both sides. When such positional deviation occurs, the positions of the images on adjacent pages differ in a created booklet. To cope with this, marks for alignment of the images are formed on both sides of the sheet, and the position of the image to be formed on each side is adjusted according to amounts of positional deviation of these marks, to match the positions of the images on both sides of the sheet (see Japanese Patent Application Laid-Open Publication No. 2006-11285).

Since the same type of sheets is fed from one feed tray, the positions of the images can be matched on both sides of the sheet fed from the one feed tray by the above-mentioned adjustment. When, however, the types of the sheets fed from the respective feed trays are different, amounts of positional deviation of the images differ among the sheets fed from the respective feed trays due to difference in characteristics of the sheet such as thickness and moisture content. The positions of the images on the sheets fed from the respective feed trays do not necessarily match one another only by adjustment to match the positions of the images on both sides of the sheet fed from each feed tray, and the positions of the images on each page may be deviated in a created booklet.

SUMMARY

An object of the present invention is to match positions of images on sheets fed from different feed trays.

To achieve at least one of the abovementioned objects, according to an aspect of the present invention, these is provided an image forming apparatus including: an image former which forms one or more images on at least one sheet fed from each of a plurality of feed trays; a first adjuster which adjusts positions of the images formed on the sheet by the image former such that the positions of the images match on both sides of the sheet fed from each of the feed trays; and a second adjuster which further adjusts the positions of the images on the sheet, the positions having been adjusted by the first adjuster, such that the positions of the images match between the sheets fed from the feed trays.

To achieve at least one of the abovementioned objects, according to another aspect of the present invention, these is provided an image forming system including; a plurality of feed trays; an image former which forms one or more images on at least one sheet fed from each of the feed trays; a first adjuster which adjusts positions of the images formed on the sheet by the image former such that the positions of the images match on both sides of the sheet fed from each of the feed trays; and a second adjuster which further adjusts the positions of the images on the sheet, the positions having been adjusted by the first adjuster, such that the positions of the images match between the sheets fed from the feed trays.

To achieve at least one of the abovementioned objects, according to another aspect of the present invention, these is provided a computer readable recording medium storing a program which causes a computer to executes: adjusting positions of images formed on at least one sheet such that the positions of the images match on both sides of the sheet fed from each of a plurality of feed trays; and further adjusting the positions of the images on the sheet, the positions having been adjusted by the first adjusting step, such that the positions of the images match between the sheets fed from the feed trays.

BRIEF DESCRIPTION OF THE DRAWINGS

The advantages and features provided by one or more embodiments of the invention will become more fully understand from the detailed description given hereinbelow and the appended drawings which are given by way of illustration only, and thus are not intended as a definition of the limits of the present invention:

FIG. 12 is a flowchart illustrating a processing procedure for adjustment of the positions of the images between the sheets;

DETAILED DESCRIPTION OF EMBODIMENTS

Hereinafter, one or more embodiments of the present invention will be described with reference to the drawings. However, the scope of the invention is not limited to the disclosed embodiments.

The embodiments of an image forming apparatus, an image forming system, and a computer readable recording medium of the present invention will be described with reference to the drawings.

Figure 1:
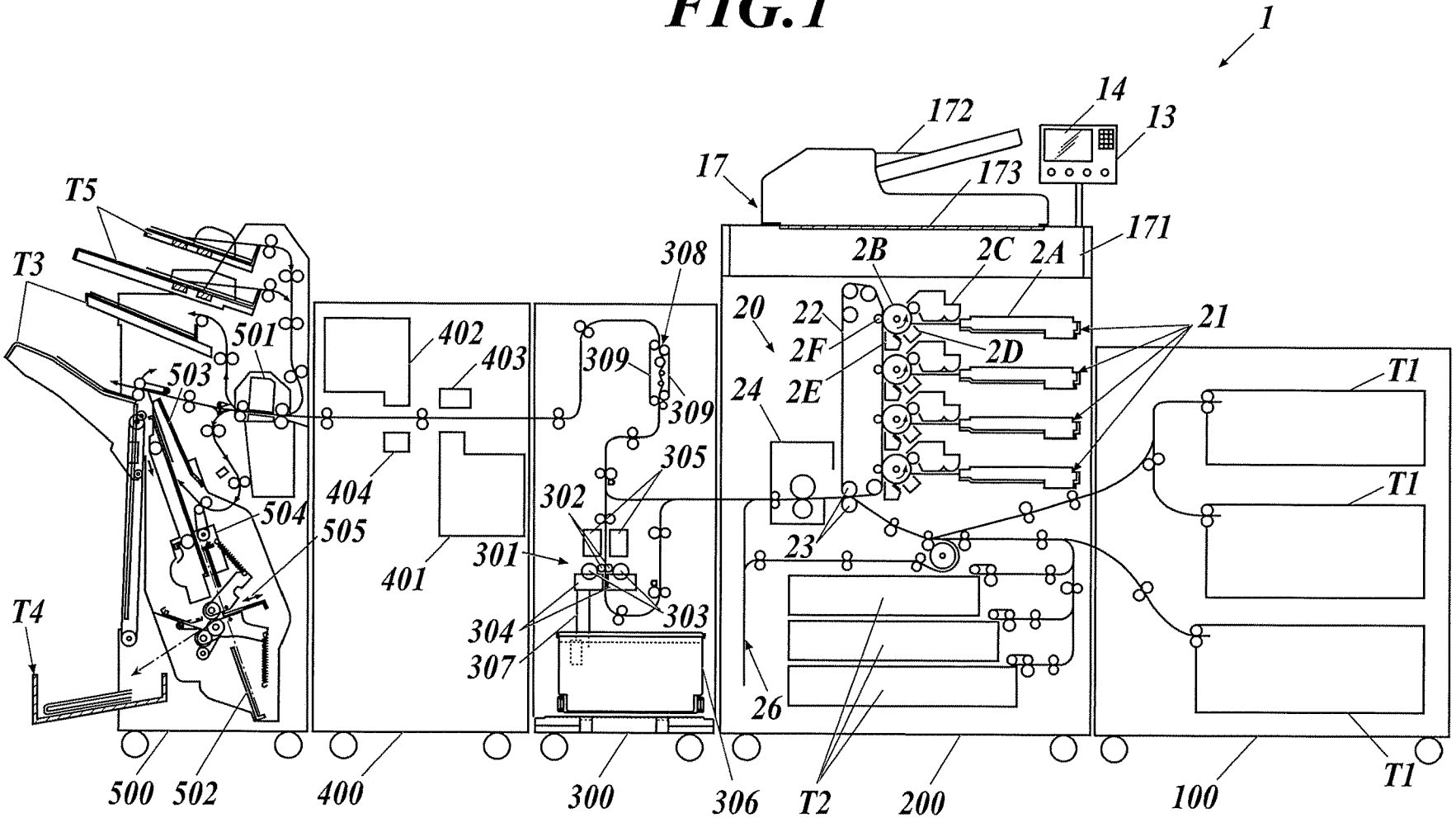
FIG. 1 is a front view illustrating a schematic configuration of an image forming system according to an embodiment of the present invention.

FIG. 1 illustrates a schematic configuration of an image forming system 1 as an embodiment of the present invention.

As illustrated in FIG. 1, the image forming system 1 includes a sheet feeding apparatus 100, image forming apparatus 200, curl straightening apparatus 300, image reading apparatus 400, sheet processing apparatus 500, and the like.

After formation of an image by the image forming apparatus 200 on a sheet fed from the sheet feeding apparatus 100, the image forming system 1 can perform various types of sheet processing such as punching a hole and creating a booklet by the sheet processing apparatus 500. The image forming system 1 can also correct curl of the sheet after the image is formed thereon by the curl straightening apparatus 300, or read a sheet surface by the image reading apparatus 400 and analyze the formed image.

[Sheet Feeding Apparatus]

As illustrated in FIG. 1, the sheet feeding apparatus 100 includes a plurality of feed trays T1, and conveys the sheet stored in each feed tray T1 to be fed to the image forming apparatus 200.

[Image Forming Apparatus]

As illustrated in FIG. 1, the image forming apparatus 200 includes an image former 20 which forms an image on the sheet. The sheet to be used can be fed from either of the feed trays T1 provided in the sheet feeding apparatus 100 or feed trays T2 provided in the image forming apparatus 200.

Figure 2:
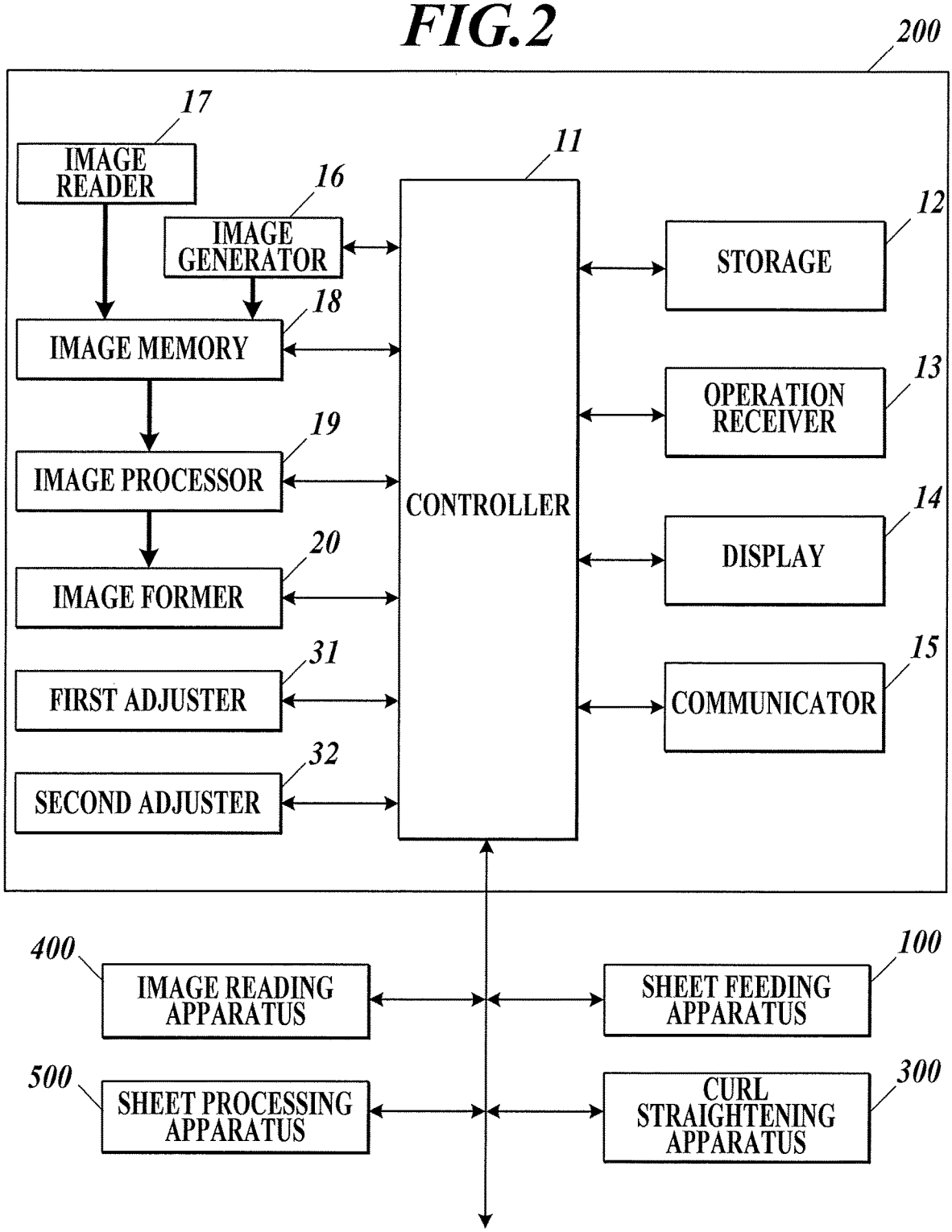
FIG. 2 is a block diagram illustrating a configuration of an image forming apparatus for respective functions.

FIG. 2 illustrates a main configuration of the image forming apparatus 200 for each function.

As illustrated in FIG. 2, the image forming apparatus 200 includes a controller 11, storage 12, operation receiver 13, display 14, communicator 15, image generator 16, image reader 17, image memory 18, image processor 19, the image former 20, a first adjuster 31, second adjuster 32, and the like.

The controller 11 includes a central processing unit (CPU), a random access memory (RAM), and the like, and controls each part by reading and executing various programs from the storage 12.

For example, the controller 11 causes the image processor 19 to perform image processing on image data generated by the image generator 16 or the image reader 17 and held in the image memory 18, and causes the image former 20 to form an image on the sheet on the basis of the image data after the image processing.

In addition, the controller 11 controls sheet feeding by the sheet feeding apparatus 100, curl correction by the curl straightening apparatus 300, reading by the image reading apparatus 400, sheet processing by the sheet processing apparatus 500, and the like.

The storage 12 stores, for example, a program readable by the controller 11, the first adjuster 31, the second adjuster 32, and the like, and a file used for execution of the program. As the storage 12, a large capacity memory such as a hard disk can be used.

As illustrated in FIG. 1, the operation receiver 13 and the display 14 are user interfaces provided on an upper portion of the image forming apparatus 200.

The operation receiver 13 generates an operation signal according to user's operation and outputs the operation signal to the controller 11. As the operation receiver 13, a keypad, a touch panel integrated with the display 14, or the like can be used.

The display 14 displays an operation screen or the like according to an instruction from the controller 11. As the display 14, a liquid crystal display (LCD), an organic electro luminescence display (OELD), or the like can be used.

The communicator 15 communicates with an external device/apparatus on a network, for example, a user terminal, a server, and another image forming apparatus.

The communicator 15 receives data (hereinafter referred to as page description language (PDL) data) in which content of an instruction to form an image is described in a PDL from the user terminal or the like via the network.

The image generator 16 performs rasterize processing on the PDL data received by the communicator 15, and generates image data in a bitmap format.

The image reader 17 reads a document surface and generates image data in a bitmap format. As the image reader 17, a scanner 171 provided under a platen glass 173 as illustrated in FIG. 1 can be used. In addition, the image reader 17 can include an auto document feeder (ADF) 172 to automatically feed a document to the scanner 171 by the ADF 172.

In a case where the image data generated by the image generator 16 and the image reader 17 has pixel values of three colors of red (R), green (G), and blue (B), color conversion processing is performed on the image data by the controller 11, a dedicated color converter, or the like and the image data is converted into image data having pixel values of four colors of cyan (C), magenta (M), yellow (Y), and black (K), and thereafter held by the image memory 18. A pixel value is a data value representing density of an image. For example, an 8-bit data value represents density of 0 to 255 gradations.

The image memory 18 is a buffer memory which temporarily holds the image data generated by the image generator 16 or the image reader 17. As the image memory 18, a dynamic RAM (DRAM) or the like can be used.

The image processor 19 reads the image data from the image memory 18 and applies various types of image processing such as density correction processing and halftone processing. The density correction processing is processing to convert each pixel value of the image data such that density characteristics of the image on the sheet become target density characteristics. The halftone processing is processing to reproduce a halftone in a pseudo manner, such as dither processing and error diffusion processing.

The image former 20 forms an image including four colors of C, M, Y, and K on the sheet according to the pixel values of the four colors of each pixel of the image data on which the image processing is performed by the image processor 19.

As illustrated in FIG. 1, the image former 20 includes four writing units 21, an intermediate transfer belt 22, secondary transfer rollers 23, a fixing device 24, a plurality of feed trays T2, and the like.

The four writing units 21 are arranged in series (tandem) along a belt surface of the intermediate transfer belt 22, and form images of respective colors of C, M, Y, and K. Each writing unit 21 has the same configuration except that the color of the image to be formed is different, and includes an exposurer 2A, a photoreceptor 2B, a developer 2C, a charger 2D, a cleaner 2E, and a primary transfer roller 2F, as illustrated in FIG. 1.

In each writing unit 21, after the photoreceptor 2B is charged by the charger 2D, a laser beam modulated on the basis of the image data is emitted in the exposurer 2A, and the rotating photoreceptor 2B is scanned with the laser beam to form an electrostatic latent image. The developer 2C supplies a toner onto the photoreceptor 2B, and develops the electrostatic latent image on the photoreceptor 2B. When the images formed on the photoreceptors 2*b* of the four writing units 21 in this manner are sequentially superimposed and transferred (primary transfer) onto the intermediate transfer belt 22 by the primary transfer rollers 2*f*, an image including respective colors is formed on the intermediate transfer belt 22. After the primary transfer, the toner remaining on the photoreceptor 2B is removed by the cleaner 2E.

When the sheet is fed from the feed tray T1 or T2, the image is transferred (secondary transfer) from the intermediate transfer belt 22 onto the sheet by the secondary transfer roller 23, and the sheet is heated and pressurized in fixing processing by the fixing device 24. In a case where images are formed on both sides of the sheet, the sheet may be conveyed to the secondary transfer roller 23 again after the sheet is conveyed to a conveyance path 26 and a surface of the sheet is reversed.

The first adjuster 31 adjusts the positions of the images formed by the image former 20 such that the positions of the images on both sides of the sheet fed from each of the feed trays T1 and T2 match each other.

The second adjuster 32 further adjusts the positions of the images formed on each sheet adjusted by the first adjuster 31 such that the positions of the images match between the sheets fed from the respective feed trays T1 and T2.

The first adjuster 31 and the second adjuster 32 can adjust the position of the image to be formed by applying, to the image data, image processing such as enlargement, reduction, shift, rotation, and affine transformation. In this case, the position of the image can be adjusted by the first adjuster 31 and the second adjuster 32 by software processing in which a program for image processing is executed by a processor such as the CPU or a graphic processor unit (GPU). In addition to the image processing, the position of the image to be formed may be adjusted by the first adjuster 31 and the second adjuster 32 also by a mechanical action such as a shift mechanism which shifts the position of a conveyance roller which clamps a sheet.

[Curl Straightening Apparatus]

As illustrated in FIG. 1, the curl straightening apparatus 300 includes a humidification processor 301, a straightener 308, and the like. The curl straightening apparatus 300 corrects curl of the sheet conveyed from the image forming apparatus 200 by the straightener 308. The sheet can pass through or bypass the humidification processor 301 before the sheet is transported to the straightener 308.

The humidification processor 301 humidifies the sheet, and thereby facilitates correction of the curl. The humidification processor 301 includes pairs of humidifying rollers 302, supply rollers 303, tanks 304, and dryers 305, which are arranged symmetrically via a conveyance path for the sheet. The humidification processor 301 further includes a large-capacity tank 306, a liquid supply pipe 307, and the like.

In the humidification processor 301, a humidifying liquid is applied by the pair of humidifying rollers 302 to a surface of the sheet to be conveyed, and the surface is dried in the dryers 305 provided with a fan, a heater and the like. Water is preferably used as the humidifying liquid, but an additive such as a surfactant may be contained in the humidifying liquid within a range not damaging the image. The supply rollers 303 partly immersed in the humidifying liquid in the tanks 304 are brought into pressure-contact with the humidifying rollers 302, and supply the humidifying liquid in the tanks 304 to the humidifying rollers 302. The humidifying liquid in the tanks 304 is refilled from the tank 306 which stores a large volume of the humidifying liquid by a pump or the like via the liquid supply pipe 307.

The straightener 308 includes a pair of conveyance belts 309, and clamps and conveys the sheet by each conveyance belt 309, and thereby straightens the curl of the sheet. Each conveyance belt 309 is wound by a plurality of rollers having different roller diameters and forms the conveyance path for the sheet, the conveyance path having a plurality of curves having different curvatures for each roller. The curl can be straightened by conveyance of the sheet to the conveyance path having the curves and bending of the sheet repeatedly in one direction and the opposite direction.

[Image Reading Apparatus]

As illustrated in FIG. 1, the image reading apparatus 400 includes image readers 401 and 402 on the conveyance path for the sheet, and reads both sides of the sheet by the image readers 401 and 402. Background members 403 and 404 for the sheet are respectively disposed at positions opposing the image readers 401 and 402 via the sheet.

[Sheet Processing Apparatus]

As illustrated in FIG. 1, the sheet processing apparatus 500 includes a puncher 501, a stacker 502, an aligner 503, a binder 504, a folder 505, and the like, applies various types of sheet processing to the sheet conveyed from the image reading apparatus 400 and discharges the sheet to a sheet discharge tray T3 or T4. Note that the sheet on which the sheet processing is to be performed may be manually fed from a feed tray T5.

The puncher 501 performs punching processing on the sheet to form a punch hole.

The stacker 502 stacks a plurality of sheets. When the plurality of sheets is bound or folded, the sheets may be sequentially conveyed to and stacked by the stacker 502. A stopper is formed in a conveying direction of the sheet of the stacker 502. Tips of the sheets abut on the stopper, and positions of end portions of the conveying direction are aligned.

The aligner 503 brings an aligning member into contact with end portions of a width direction of the plurality of sheets stacked on the stacker 502, and aligns the positions of the end portions of the width direction. The width direction is orthogonal to the conveying direction of the sheet.

The binder 504 binds the plurality of sheets stacked on the stacker 502 by a stapler or the like.

The folder 505 folds the plurality of sheets stacked on the stacker 502.

When a booklet is created, the sheets are stacked on the stacker 502, and the end portions of the stacked sheets are aligned by the aligner 503. Thereafter, the binder 504 binds the sheets at a binding position designated by a user and folds the sheets in the folder 505. The completed booklet is discharged to the discharge tray T4.

[Adjustment of Positions of Images on Both Sides of Sheet Fed from Each Feed Tray]

In a case where the images are formed on both sides of the sheet, when assuming that the side on which the image is formed earlier is a first surface and the side on which the image is formed later is a second surface, the sheet pressurized and heated in the fixing processing may contract or expand at the time of formation of the image on the first surface, and as a result, the size of the sheet may be changed at the time of formation of the image on the second surface. Accordingly, the positions of the images may be deviated between the first surface and the second surface.

In the image forming apparatus 200, the position of the image to be formed on each side of the sheet fed from each of the feed trays T1 and T2 can be adjusted by the first adjuster 31 such that the positions of the images match on both sides of the sheet.

At the time of the adjustment, the sheet is sequentially fed from each of the feed trays T1 and T2, reference images for position adjustment are formed on the first surface and the second surface of each sheet by the image former 20, and the positions of the reference images on the first surface and the second surface are specified in the first adjuster 31. The positions of the reference images may be specified as positions detected by analyzing a read image data generated by reading the first surface and the second surface by the first adjuster 31. Alternatively, the user may measure the positions of the reference images on the sheet and specify the positions as positions input by the operation receiver 13. As read image data generating means, the image reader 17 and the image reading apparatus 400 can be used.

As the reference image, a general image for position adjustment such as a cross-shaped register mark can be used, but as long as the position in a width direction X and a conveying direction Y on the sheet can be specified, the reference image is not limited to the register mark, and other images may be used.

It is preferable that the image former 20 forms, in addition to the reference images, an identification image which indicates which feed tray, among the plurality of feed trays T1 and T2, has fed the sheet on which the reference images are formed. It is possible to easily distinguish from which feed tray the sheet on which the same reference images are formed is fed by the identification image.

The name, number, and the like of each feed tray, for example, tray 1 and tray 2 can be formed as the identification image.

Figure 3:
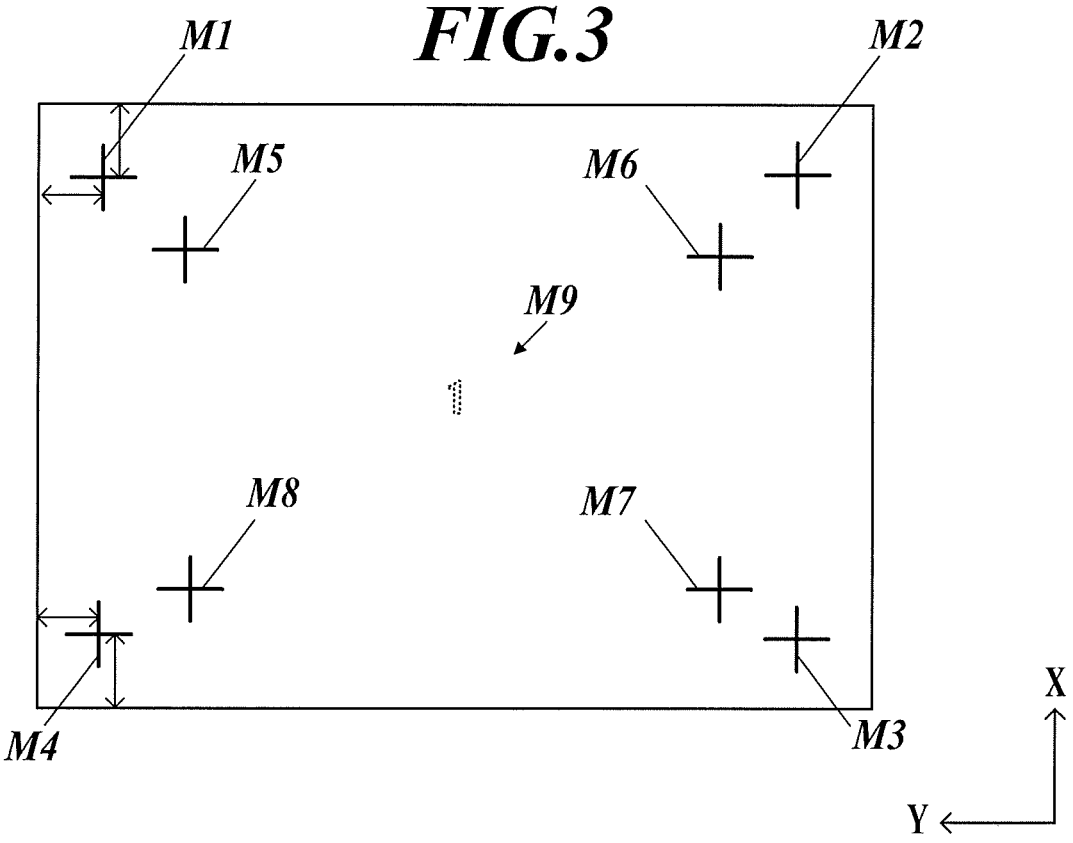
FIG. 3 is a top view illustrating an example of reference images for position adjustment.

FIG. 3 illustrates an example of the reference images and the identification image.

As illustrated in FIG. 3, eight reference images M1 to M8 and an identification image M9 are formed on the sheet. The reference images M1 to M4 are respectively formed at positions where distances from four corners of the sheet are the same in the width direction X and the conveying direction Y of the sheet. Similarly, the reference images M5 to M8 are respectively formed at positions on the inner side of the sheet than the reference images M1 to M4, where the distances from the four corners of the sheet are the same. In addition, "1" is formed as the identification image M9, the "1" being the number of the feed tray for the sheet on which the reference images are formed.

From the eight reference images M1 to M8, by using at least two reference images, positional deviation of the image in the width direction X or the conveying direction Y can be detected, and by using three or more reference images, positional deviation of the image by skew (inclination) or bow (bending) can be detected.

The first adjuster 31 decides amounts of positional deviation of the reference images on the first surface and the second surface, and the position of the image formed on the first surface or the second surface is adjusted according to the decided amounts of positional deviation such that the positions of the images on the first surface and the second surface match each other. For example, the first adjuster 31 can perform image processing such as reduction or enlargement, affine transformation, and shift on the image data on the second surface so as to eliminate positional deviation from the reference images on the first surface. As described above, the position of the image on the second surface may be adjusted according to the position of the reference images on the first surface, and vice versa, or both of the positions of the images on the first surface and the second surface may be adjusted according to a certain reference position.

[Adjustment of Positions of Images between Sheets Fed from Respective Feed Trays]

As described above, in a case where the positions of the images on both sides of the sheet are adjusted by the first adjuster 31, the positions of the images can be matched between the sheets fed from the same feed tray. However, in a case where the types of the sheets differ, the amounts of positional deviation of the images after the fixing processing differ due to difference in characteristics of the sheet such as thickness and moisture content. Therefore, even if the positions of the images match on both sides of each sheet, the positions of the images do not necessarily match between the sheets fed from the different feed trays.

Figure 4A:
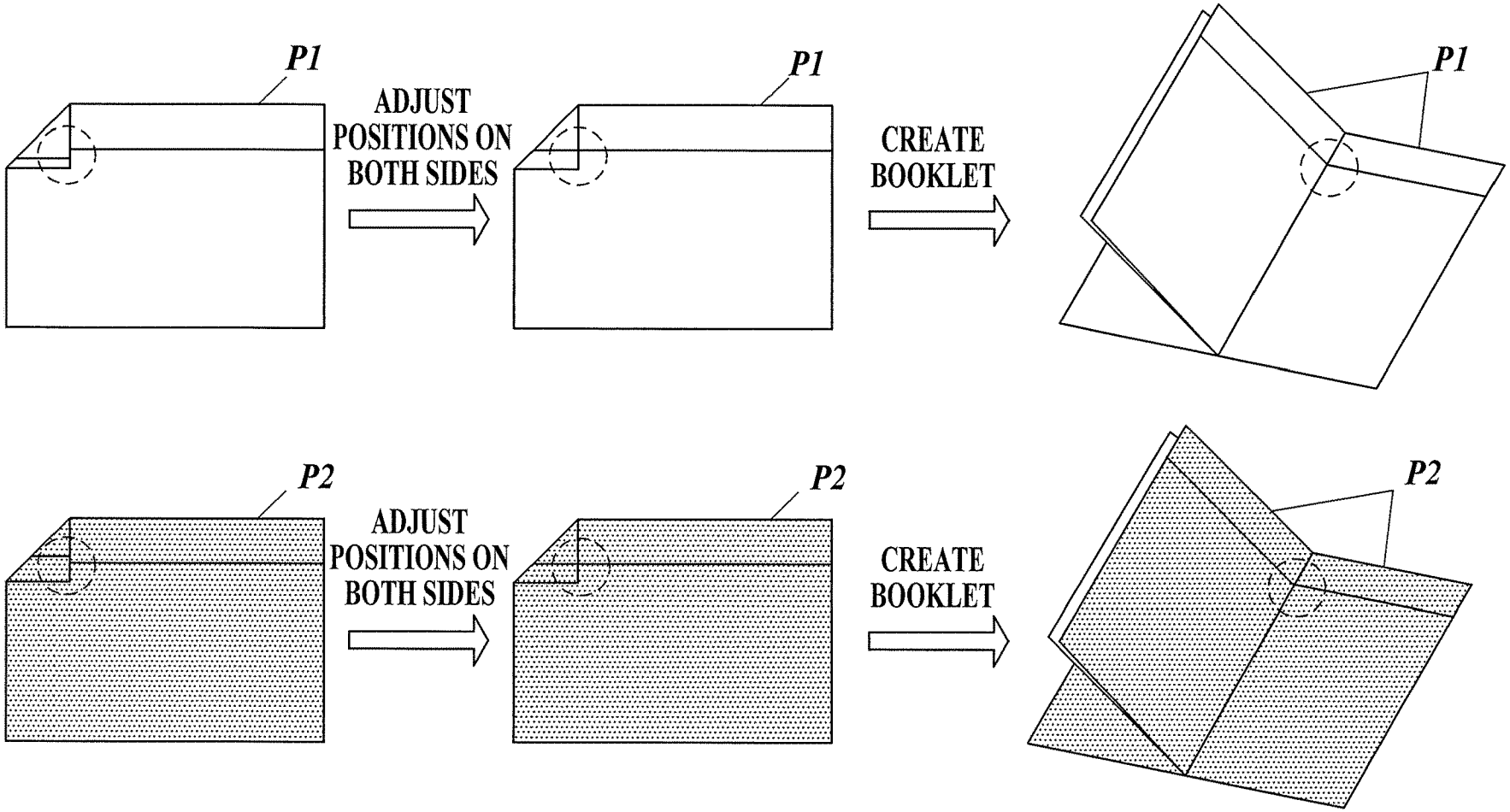
FIG. 4A illustrates booklets each of which is created by use of sheets fed from the same feed tray after adjustment of positions of images on both sides of the sheet fed from each feed tray.

FIG. 4A illustrates sheets P1 and P2 fed from the different feed trays.

As illustrated in FIG. 4A, in a case where the positions of the images on both sides of each of the sheets P1 and P2 are adjusted by the first adjuster 31 and thereafter booklet using the sheets P1 and a booklet using the sheets P2 are created, the positions of line images match on both sides of the sheet P1 and the positions of the line images match also on both sides of the sheet P2. Therefore, the positions of the line images match in adjacent pages of each booklet, and continuous ruled lines can be formed on each page.

Figure 4B:
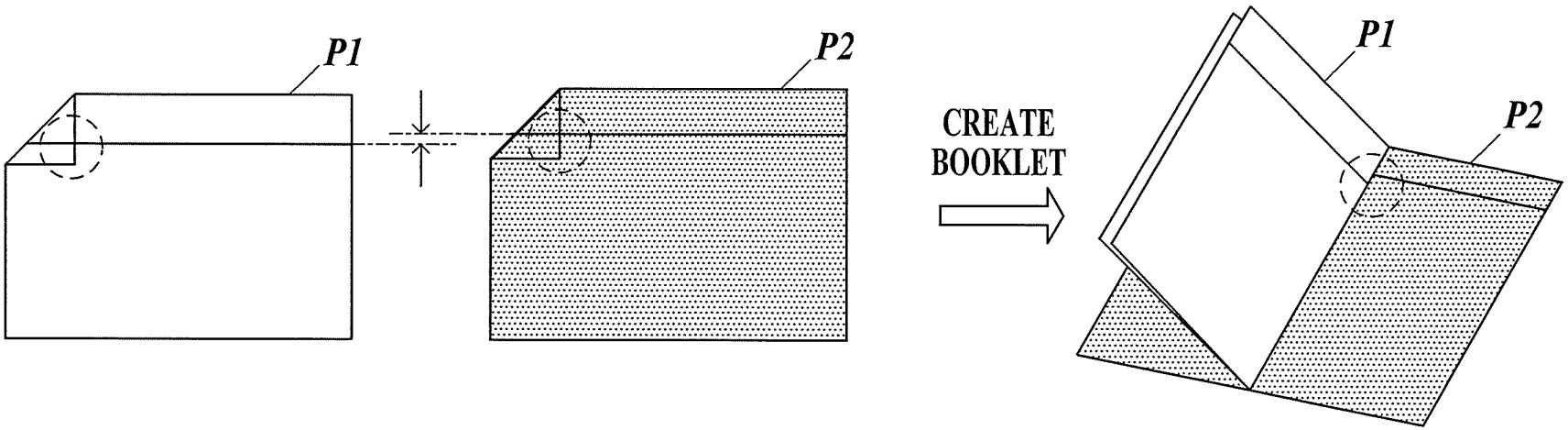
FIG. 4B illustrates a booklet created by combination of sheets fed from different feed trays after adjustment of the positions of the images on both sides of the sheet fed from each feed tray.

FIG. 4B illustrates a booklet created by combination of the sheets P1 and P2.

As illustrated in FIG. 4B, in the sheets P1 and P2 on which the positions of the images on both sides are adjusted, while the positions of the line images match on the sheet P1 and on the sheet P2, the positions of the line images do not match between the sheets P1 and P2. Thus the position of the line image on the page of the sheet P1 is deviated from that of the sheet P2 which is adjacent to the sheet P1 in the booklet.

The image forming apparatus 200 can eliminate, by the second adjuster 32, such positional deviation of the images between different types of the sheet fed from the different feed trays.

Figure 4C:
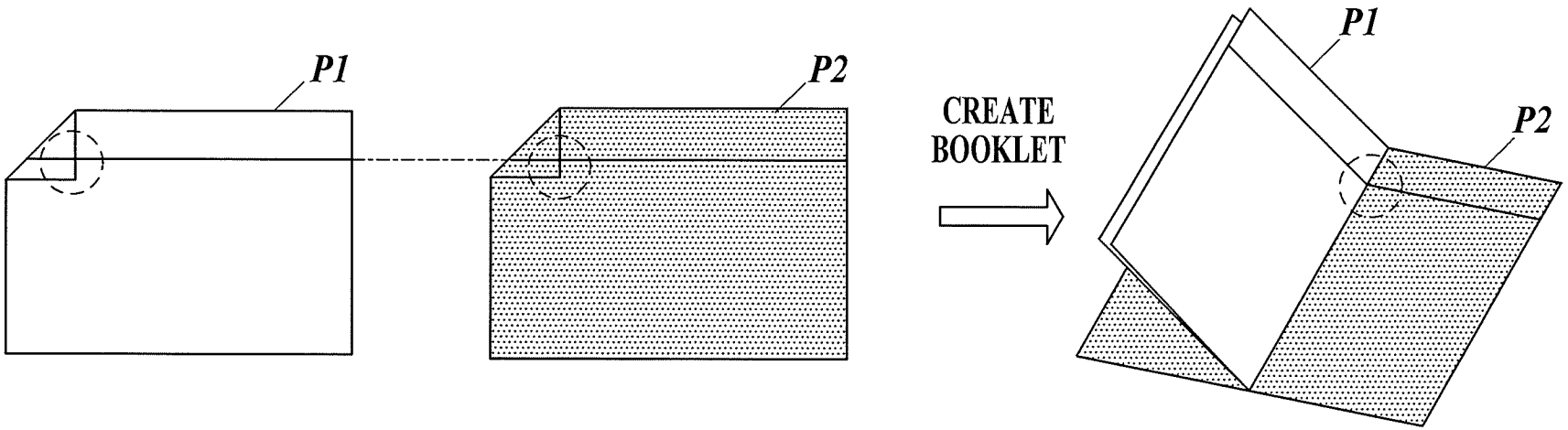
FIG. 4C illustrates a booklet created by combination of the sheets fed from the different feed trays after adjustment of the positions of the images on both sides of the sheet fed from each feed tray and the positions of the images among the sheets fed from the respective feed trays.

FIG. 4C illustrates a booklet created by combination of the sheets P1 and P2 on which the positions of the images are adjusted by the second adjuster 32.

As illustrated in FIG. 4C, in the sheets P1 and P2, the positions of the line images match not only on the same sheet P1 and on the same sheet P2 but also between the different sheets P1 and P2. Accordingly, the positions of the line images on the pages of the sheets P1 and P2 which are adjacent to each other in the booklet also match each other.

The adjustment by the second adjuster 32 is performed after the positions of the images are adjusted by the first adjuster 31. Specifically, the sheet is sequentially fed from each of the feed trays T1 and T2, the reference images for position adjustment are formed on each sheet by the image former 20, and the positions of the reference images on each sheet are specified in the second adjuster 32. Formation of the reference images and identification of the positions thereof can be performed in a procedure similar to the procedure performed in the first adjuster 31.

The second adjuster 32 decides the amounts of positional deviation of the reference images on the sheet fed from each of the feed trays T1 and T2, and further adjusts the positions of the images formed on each sheet adjusted by the first adjuster 31 according to the decided amounts of positional deviation such that the positions of the images match between the sheets fed from the respective feed trays T1 and T2.

Figure 5A:
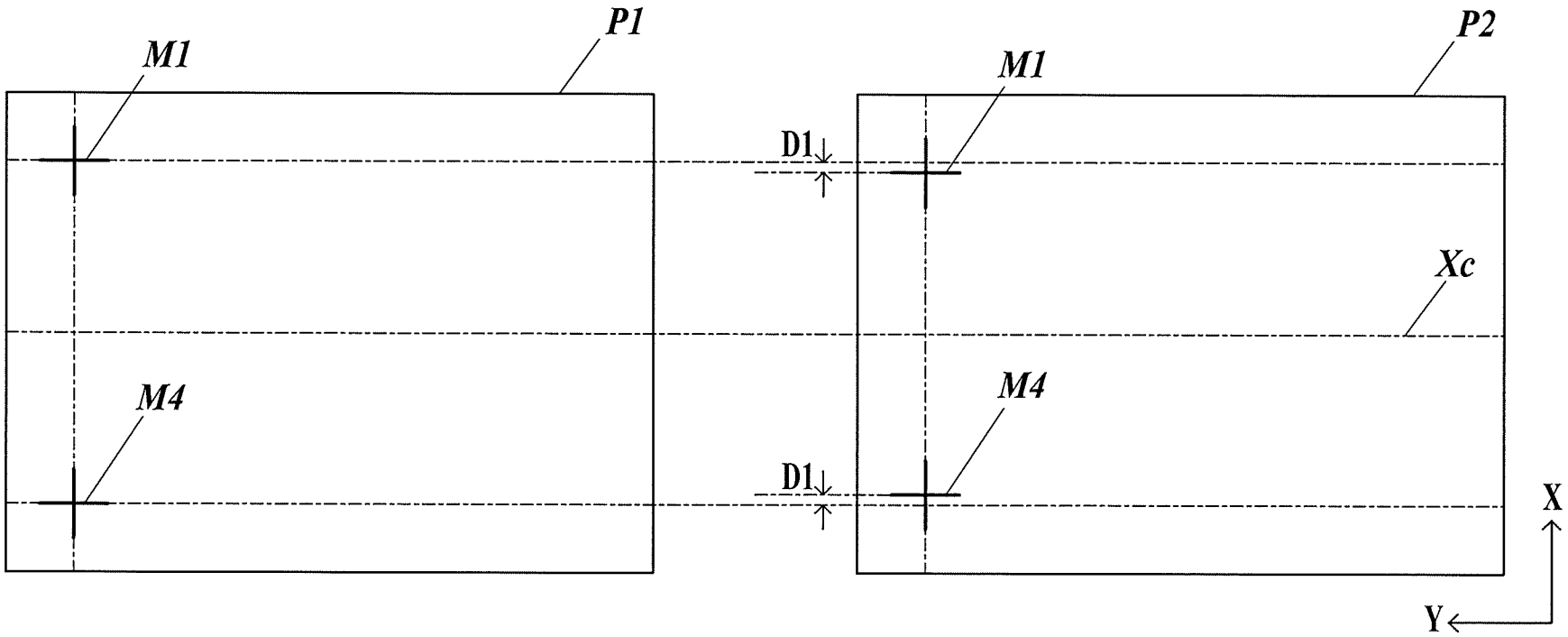
FIG. 5A illustrates the sheets fed from the respective feed trays, on which reference images are formed.

FIG. 5A illustrates the sheets P1 and P2 on which the positions of the images on both sides have been adjusted by the first adjuster 31.

As illustrated in FIG. 5A, even after the positions of the images on both sides of each of the sheets P1 and P2 are adjusted, the positions of the reference images M1 and M4 on the sheet P2 are deviated from the positions of the reference images M1 and M4 on the sheet P1 toward a center position Xc in the width direction X by an amount of positional deviation D1. To address this positional deviation, the second adjuster 32 performs image processing for enlarging the image to be formed on the sheet P2 by the amount of positional deviation D1 on the image data corresponding to the sheet P2, for example.

Figure 5B:
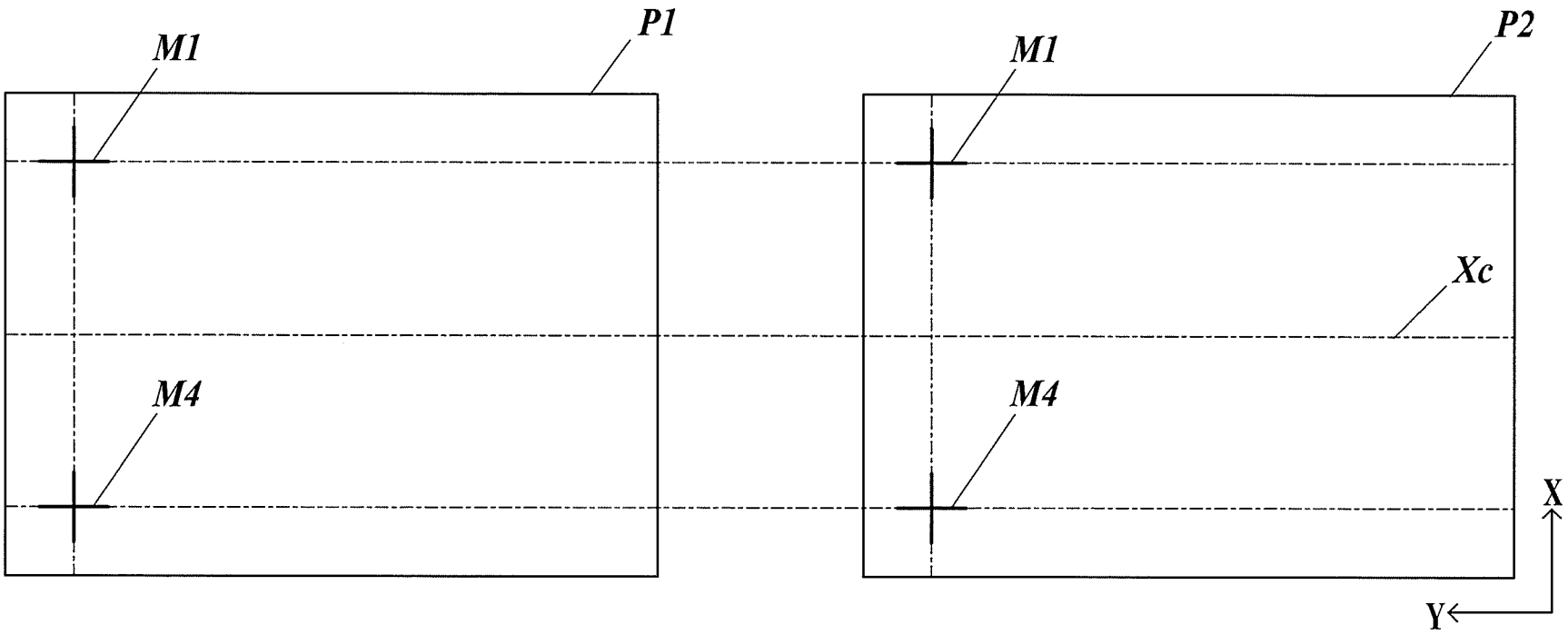
FIG. 5B illustrates the sheets fed from the respective feed trays after adjustment of the positions of the images between the sheets fed from the respective feed trays.

FIG. 5B illustrates the sheets P1 and P2 on which the positions of the images have been adjusted by the second adjuster 32.

As illustrated in FIG. 5B, the positions of the reference images M1 and M4 match between the sheets P1 and P2 by the adjustment of the second adjuster 32.

Assuming that any one of the plurality of feed trays T1 and T2 is a reference tray, the second adjuster 32 can adjust the positions of the images on the sheet fed from a feed tray other than the reference tray such that the positions of the reference images on the sheets fed from the other feed tray match the positions of the reference images on the sheet fed from the reference tray.

In addition, FIG. 5B illustrates an example in which the positions of the images on the sheets P1 and P2 are adjusted to match with respect to the center position Xc in the width direction X. The second adjuster 32 can also perform, however, the adjustment such that the positions of the images match between the sheets when the sheets which are fed from the feed trays T1 and T2 and on which the images are formed are aligned in accordance with a position of the end portions of any one of the sheets.

Even if the size of the sheet fluctuates due to contraction or expansion, it is possible to match the positions of the images between the sheets when the sheets are aligned by adjusting the positions of the images in accordance with the aligned end portions.

Figure 6A:
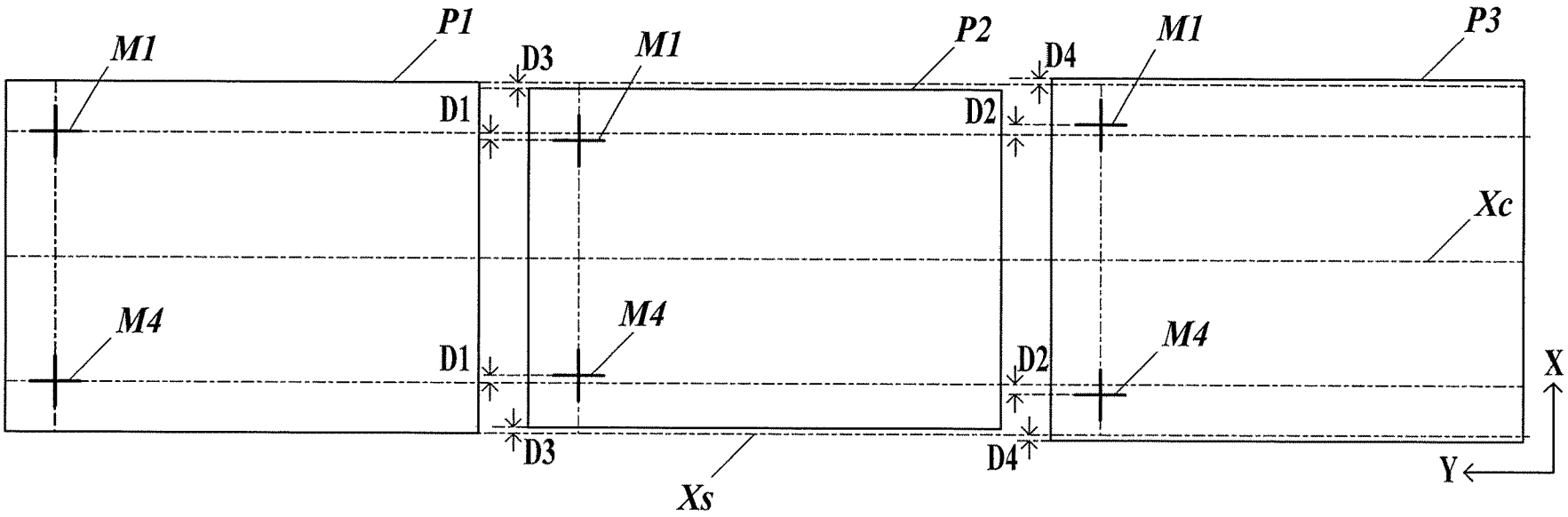
FIG. 6A illustrates the sheets fed from the respective feed trays, on which the reference images are formed.

FIG. 6A illustrates the sheets P1 to P3 fed from the three feed trays, on which the positions of the images on both sides are adjusted by the first adjuster 31.

As illustrated in FIG. 6A, the sheet P2 is smaller than the sheet P1 and the sheet P3 is larger than the sheet P1. Therefore, when the center positions Xc in the width direction X of the sheets P1 to P3 are aligned, the positions of the end portions of the sheets P2 and P3 are deviated from the position of the end portion in the width direction X of the sheet P1 by amounts of positional deviation D3 and D4, respectively. When the sheets P1 to P3 are aligned with respect to a position Xs at one end in the width direction X, the reference images M1 and M4 on the sheet P2 and the reference images M1 and M4 on the sheet P3 are deviated toward the position Xs by the amounts of positional deviation D3 and D4, respectively. In a case where the positions of the images are adjusted by use of the feed tray for the sheet P1 as the reference tray, for example, the second adjuster 32 performs, on the image data on the sheet P2, image processing for enlarging the images in accordance with the amount of positional deviation D1, and then image processing for shifting the positions of the images according to the amount of positional deviation D3. Similarly, the second adjuster 32 performs, on the image data of the sheet P3, image processing for reducing the images in accordance with the amount of positional deviation D2, and then image processing for shifting the positions of the images according to the amount of positional deviation D4.

Figure 6B:
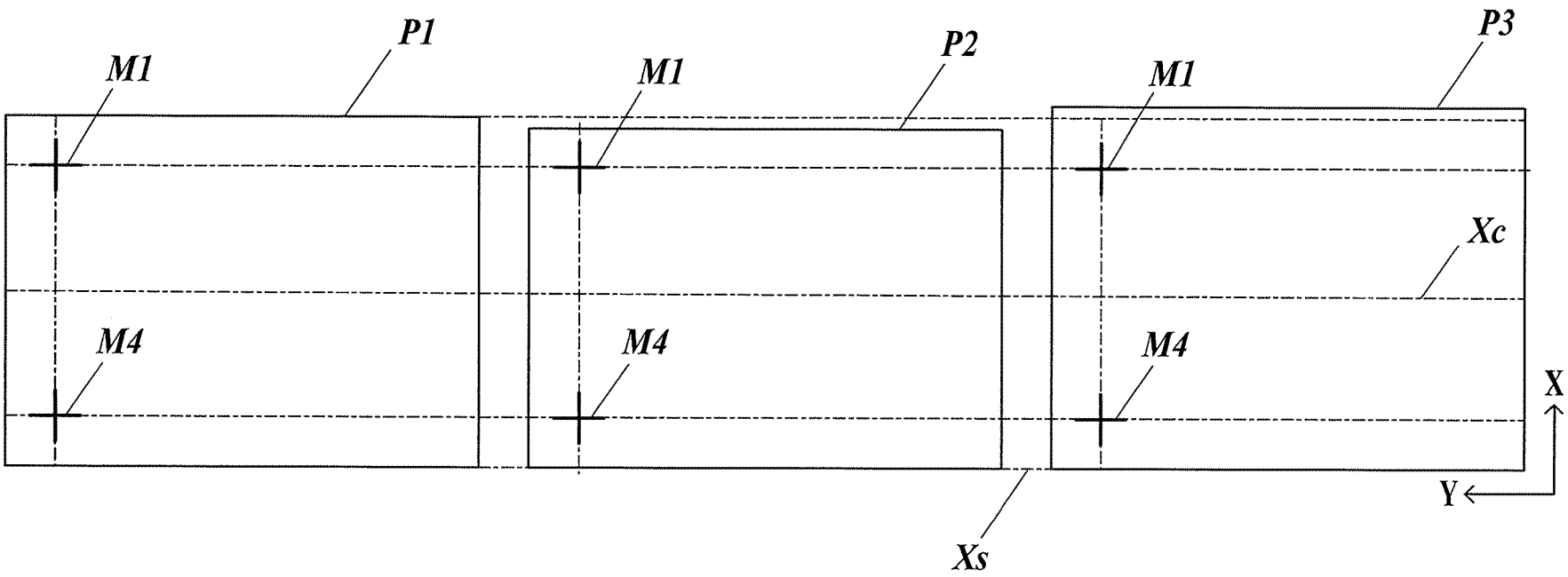
FIG. 6B illustrates the sheets fed from the respective feed trays after adjustment of the positions of the images among the sheets fed from the respective feed trays according to alignment positions.

FIG. 6B illustrates the sheets P1 to P3 on which the positions of the images among the sheets have been adjusted by the second adjuster 32.

As illustrated in FIG. 6B, the positions of the images when the sheets P1 to P3 are aligned with respect to the position Xs at the end portions of the sheets P1 to P3 match among the sheets P1 to P3 by the adjustment of the second adjuster 32.

Figure 7:
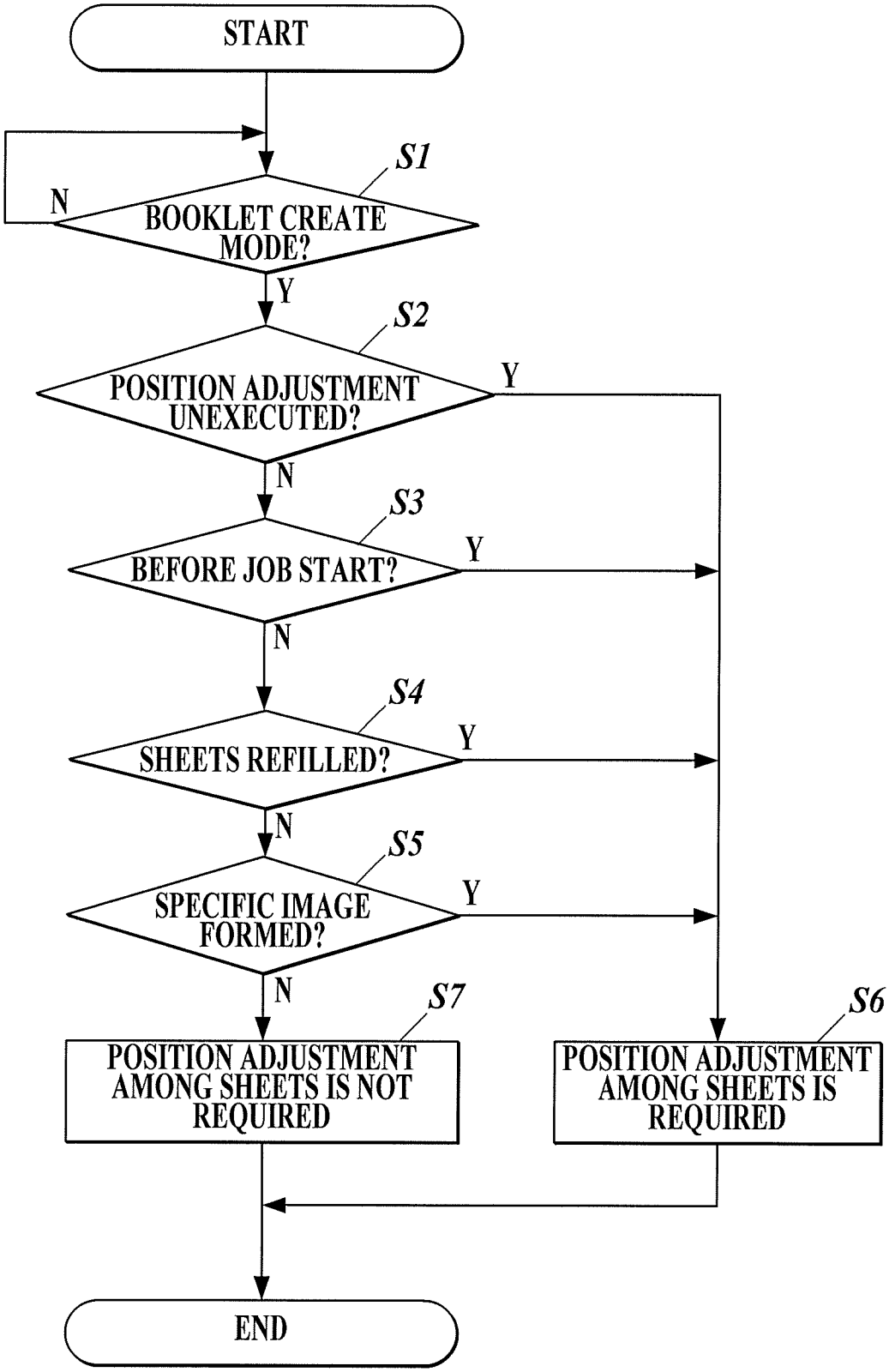
FIG. 7 is a flowchart illustrating a processing procedure when necessity of adjustment of the positions of the images between the sheets fed from the respective feed trays is decided.

FIG. 7 illustrates a processing procedure when necessity of the adjustment of the positions of the images by the second adjuster 32 is decided in the image forming system 1.

As illustrated in FIG. 7, when a booklet create mode is selected by the user (Step S1: Y), the controller 11 decides whether the adjustment of the positions of the images by the second adjuster 32 is necessary.

Specifically, in a case where the adjustment of the positions of the images by the second adjuster 32 has not been performed (Step S2: Y), a case where it is before start of a job (Step S3: Y), a case where a sheet has been refilled to the feed trays T1 and T2 (Step S4: Y), or a case where specific images whose positions and contents are the same are formed on the sheets fed from different feed trays (Step S5: Y), the controller 11 decides that the adjustment of the positions of the images by the second adjuster 32 is necessary (Step S6). In a case where none of the above conditions are satisfied (Step S2: N, S3: N, S4: N, and S5: N), the controller 11 decides that the position adjustment is unnecessary (Step S7).

As a result of such a decision, the adjustment can be performed when the adjustment has not been performed or when it is before the start of the job, and the positions of the images formed in the job to be executed can be adjusted. In addition, even when a sheet is refilled, the adjustment can be performed, and even in a case where a new type of sheet is refilled, the adjustment can be immediately performed. The adjustment can also be performed when a specific image in which positional deviation is conspicuous is formed.

Examples of the specific image include the line images having the same line width formed at the same position on the sheets P1 and P2 as illustrated in FIG. 4C. The position adjustment by the second adjuster 32 is highly effective for the images at the same position and having the same content, as the positional deviation between such images tends to be conspicuous when a booklet is created by combination of the sheets P1 and P2 and the images on the sheets P1 and P2 are adjacent to each other.

In a case where there is such a specific image, whether to adjust the positions of the images may be selected by the user.

Figure 8:
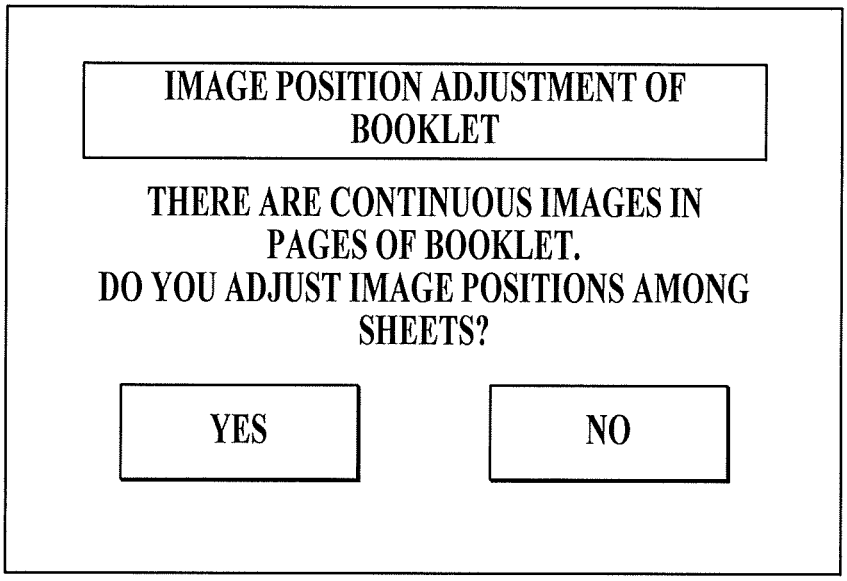
FIG. 8 illustrates an example of an operation screen on which execution of the adjustment of the positions of the images can be selected.

FIG. 8 illustrates an example of the operation screen on which execution of adjustment can be selected.

As illustrated in FIG. 8, the operation screen is provided with operation buttons for selection whether or not to adjust the positions of the images between the sheets.

The controller 11 may determine that the adjustment by the second adjuster 32 is necessary in a case where selection to perform the adjustment is made with this operation button.

Figure 9:
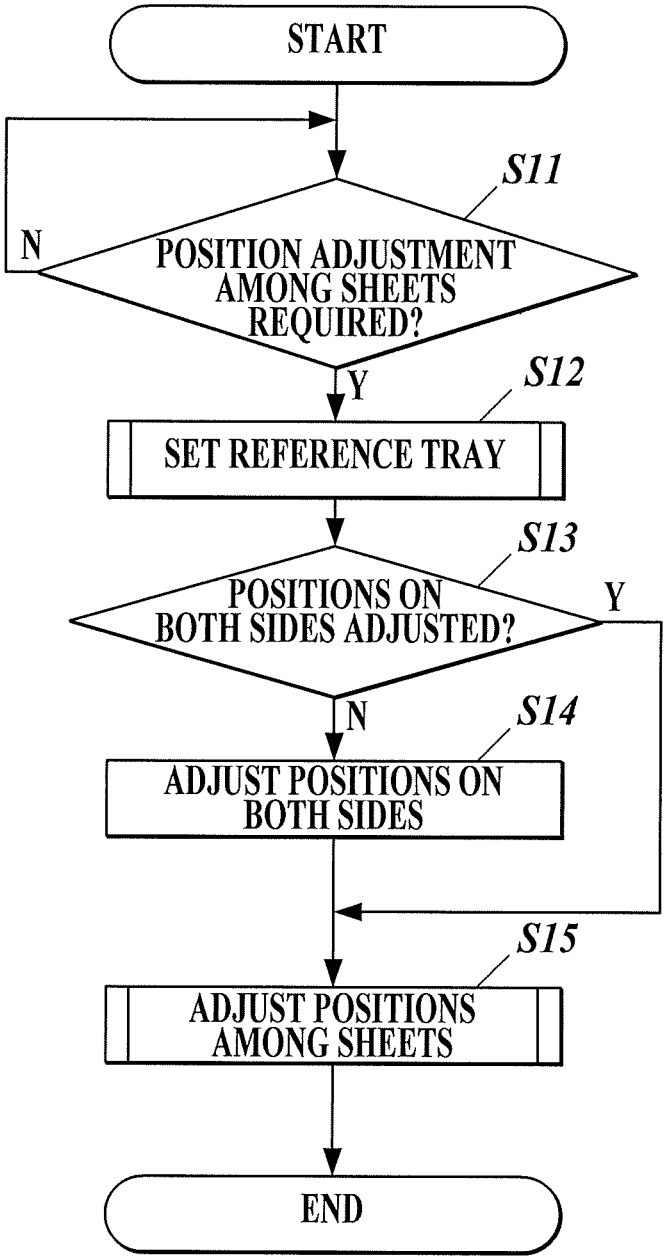
FIG. 9 is a flowchart illustrating a processing procedure when the adjustment of the positions of the images between the sheets fed from the respective feed trays is executed.

FIG. 9 illustrates a processing procedure when the adjustment of the positions of the images by the second adjuster 32 is performed in the image forming system 1.

As illustrated in FIG. 9, in a case where it is decided that the position adjustment is necessary in the above-mentioned determination of necessity (Step S11: Y), the controller 11 sets any one of the plurality of feed trays T1 or T2 as the reference tray (Step S12).

Figure 10:
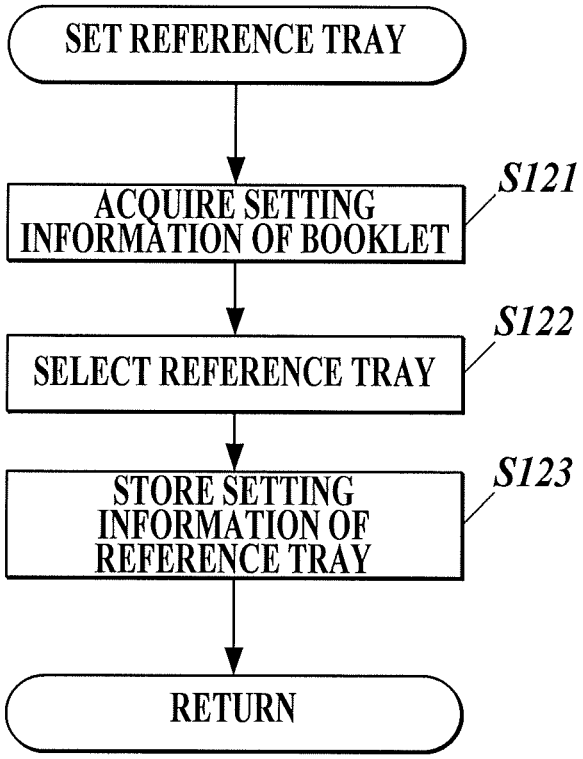
FIG. 10 is a flowchart illustrating a processing procedure when a reference tray is set.

FIG. 10 illustrates a processing procedure when the reference tray is set.

As illustrated in FIG. 10, the controller 11 acquires booklet setting information set by the user when the booklet create mode is selected (Step S121). The booklet setting information is, for example, information of the feed tray for the sheet to be used for creation of the booklet, a binding position of the sheet, and an alignment position of the sheet.

The controller 11 identifies the feed tray for the sheet to be used on the basis of the obtained booklet setting information, and causes the display 14 to display the operation screen on which the reference tray can be selected from the specified feed trays.

Figure 11:
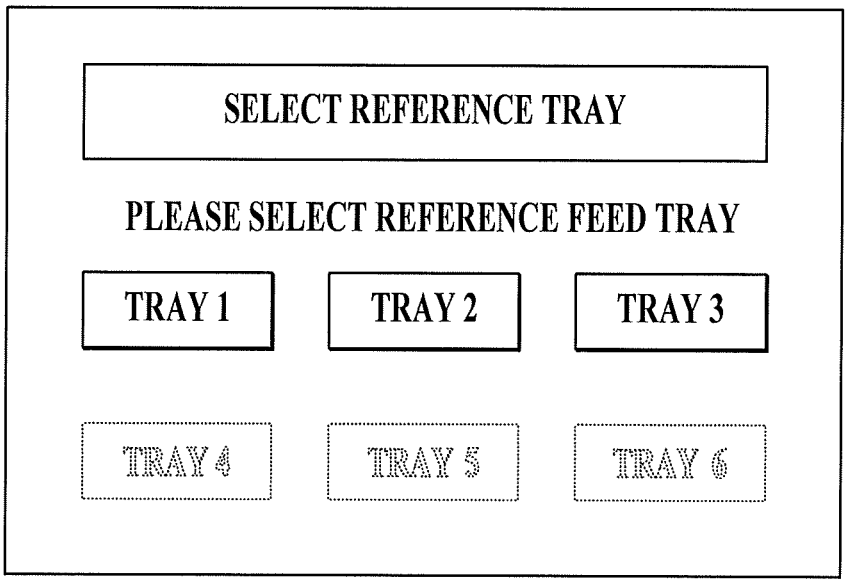
FIG. 11 illustrates an example of the operation screen on which the reference tray can be selected.

FIG. 11 illustrates an example of the operation screen on which the reference tray can be selected.

As illustrated in FIG. 11, buttons of trays 1 to 6 representing six feed trays are displayed on the operation screen. Among the buttons of the trays 1 to 6, the buttons of trays 1 to 3 representing the three feed trays used for creation of the booklet are operable, and the buttons of trays 4 to 6 which are not used are invalidated.

For example, in a case where the sheet fed from the tray 1 is used as a front cover of the booklet and the sheets fed from the trays 2 and 3 are used as a main body of the booklet, when the position of the image on the main body is to be matched to the position of the image on the cover of the booklet, the user can select the tray 1 as the reference tray.

When any one of the feed trays is selected by the user via the operation receiver 13 (Step S122), the controller 11 saves the setting information for setting the selected feed tray as the reference tray in the storage 12 (Step S123).

As illustrated in FIG. 9, after the reference tray is set, in a case where the adjustment of the positions of the images on both sides of the sheet has not been performed yet by the first adjuster 31 (Step S13: N), after the adjustment is performed by the first adjuster 31 (Step S14), the adjustment by the second adjuster 32 is performed (Step S15). Note that, by performing the adjustment, the first adjuster 31 calculates adjustment values of the positions of the images on both sides of the sheet fed from each feed tray, and saves the adjustment values in the storage 12. The adjustment values are enlargement ratio or reduction ratio of the image, a shift amount of the image, and the like. In a case where the position adjustment has been performed by the first adjuster 31 (Step S13: Y), the adjustment by the second adjuster 32 is immediately performed (Step S15).

FIG. 12 illustrates a processing procedure when the positions of the images between the sheets are adjusted by the second adjuster 32.

As illustrated in FIG. 12, the sheet is sequentially fed from each of the feed trays T1 and T2, and the reference images for position adjustment are formed by the image former 20 on each sheet fed (Step S21).

Figure 13:
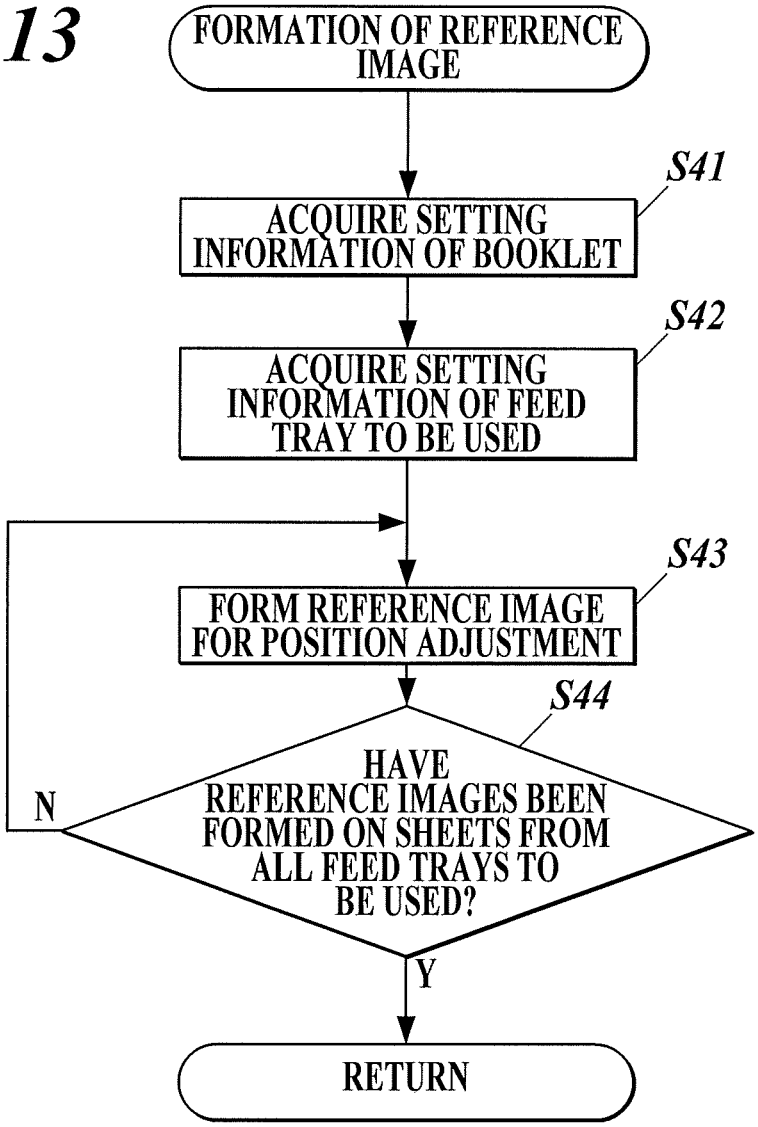
FIG. 13 is a flowchart illustrating a processing procedure when the reference images are formed.

FIG. 13 illustrates a specific processing procedure when the reference images are formed.

As illustrated in FIG. 13, the controller 11 acquires the booklet setting information (Step S41), and acquires the setting information of the feed tray to be used from the booklet setting information (Step S42).

On the basis of the acquired setting information, the controller 11 specifies, from all the usable feed trays T1 and T2, a plurality of feed trays which feed the sheets to be used for creation of the booklet, and causes each of the specified feed trays to sequentially feed the sheet, so that the reference images for position adjustment are formed by the image former 20. When the formation of the reference images on the sheets fed from all the feed trays to be used has not been completed (Step S44: N), the image former 20 repeatedly forms the reference images on the sheets fed from each of the feed trays (Step S43).

When the formation of the reference images on all the sheets is completed (Step S44: Y), the positions of the reference images on each sheet are specified. In the image forming apparatus 200, the user can select whether to automatically detect or to manually measure the positions of the reference images.

As illustrated in FIG. 12, in a case where the user selects to detect the positions of the reference images automatically (Step S22: B), each sheet surface on which the reference images are formed is read. A method of reading the sheet surface can be selected by the user. As the reading method, there are a method of reading a sheet set on the platen glass 173, a method of reading a sheet set on the ADF 172, and a method of reading a sheet on the conveyance path by the image reading apparatus 400 inline.

In a case where the reading of the sheet set on the platen glass 173 by the user is selected (Step S23: B1), the sheet surface on the platen glass 173 is read by the scanner 171 in the image reader 17 (Step S24). In a case where the reading of the sheet set on the ADF 172 is selected (Step S3: B2), each sheet is sequentially fed by the ADF 172 and the sheet surface is read by the scanner 171 (Step S25). In addition, in a case where the reading by the image reading apparatus 400 is selected (Step S23: B3), after formation of the reference images, the image reading apparatus 400 reads each sheet to be sequentially conveyed (Step S26).

The second adjuster 32 detects the reference images and specifies the position of the reference images in the read image data of each sheet generated by the reading (Step S27). Note that from which feed tray the sheet is fed can be determined on the basis of the identification image formed together with the reference images.

In a case where it is selected to perform measurement manually (Step S22: A), the second adjuster 32 specifies measured values measured by the user and input via the operation receiver 13 as the positions of the reference images on each sheet (Step S28).

Figure 14:
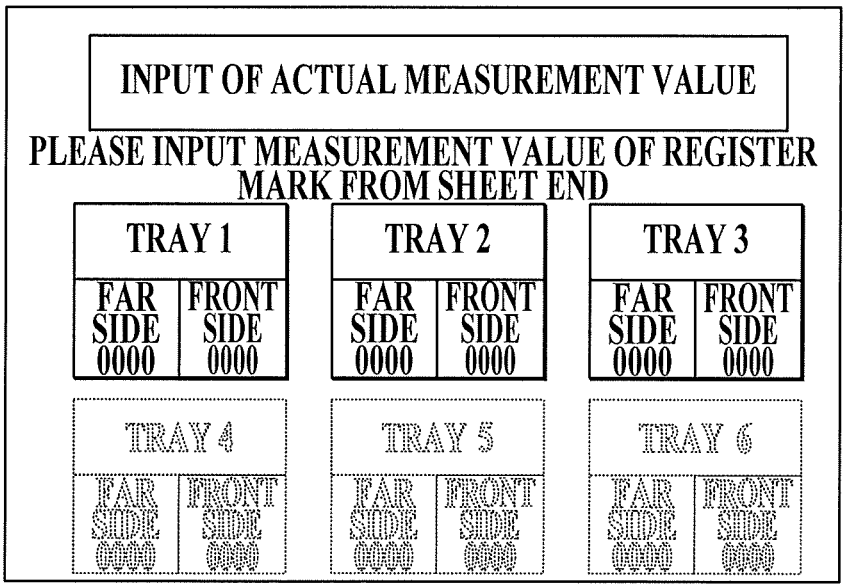
FIG. 14 illustrates an example of the operation screen on which measured values of the positions of the reference images can be input.

FIG. 14 illustrates an example of the operation screen on which the positions of the reference images can be input.

As illustrated in FIG. 14, on the operation screen, there is provided an input area into which the measured values of the distance (mm) from the end portion of the sheet to the reference images can be input for each of the trays 1 to 3 to be used.

In a case where there remains a sheet fed from the feed tray, for which the positions of the reference images have not yet been acquired (Step S29: N), the processing returns to Step S22 and the specification of the positions of the reference images is repeated.

When the positions of the reference images are specified for all the sheets (Step S29: Y), the second adjuster 32 calculates, as the amounts of positional deviation, differences between the positions of the reference images on the sheet fed from the reference tray and the positions of the reference images on the sheets fed from other feed trays. The second adjuster 32 calculates the adjustment values of the positions of the images on the sheet fed from the feed trays according to the calculated amount of positional deviation, and saves the calculated adjustment values in the storage 12 (Step S30). The adjustment values are enlargement ratio or reduction ratio of the image and a shift amount of the image, for example.

At the time of the formation of the image on the sheet fed from each feed tray, the positions of the images can be matched between the sheets fed from the respective feed trays by image processing on the image data on the basis of the adjustment values calculated in the first adjuster 31 followed by image processing on the image data on the basis of the adjustment values calculated in the second adjuster 32.

As described above, the image forming system 1 of the present embodiment includes the plurality of feed trays T1 and T2, the image former 20 which forms an image on a sheet fed from each of the plurality of feed trays T1 and T2, the first adjuster 31 which adjusts positions of images formed on each sheet by the image former 20 such that the positions of the images match on both sides of the sheet fed from each of the feed trays T1 and T2, and the second adjuster 32 which further adjusts the positions of the images on the sheet adjusted by the first adjuster 31 such that the positions of the images match between the sheets fed from the respective feed trays.

With this configuration, even in a case where different kinds of sheets are fed from the respective feed trays, it is possible not only to match the positions of the images on both sides of the sheet fed from each feed tray, but also match the positions of the images on the sheets fed from the different feed trays. Accordingly, in a case where the sheets fed from the different feed trays are combined as in a case where a booklet is created, it is possible to provide a high-quality printed matter in which there is no positional deviation of the images between adjacent pages.

The above embodiment is a preferred example of the present invention, and the present invention is not limited thereto. The above embodiment can be appropriately changed without departing from the gist of the present invention.

For example, the case where a booklet is created has been described as an example, but the position adjustment by the second adjuster 32 can be performed also in a case where different types of sheets are stacked and discharged without sheet processing. Also in a case where a user creates a booklet by folding or binding each type of the discharged sheet, it is possible to create a booklet in which the positions of the images on the different pages match one another.

As a computer readable medium storing a program, a nonvolatile memory such as a read-only memory (ROM) and a flash memory, or a portable recording medium such as a compact disc read-only memory (CD-ROM) can be applied. Carrier wave (carrier) is also applied as a medium which provides program data via a communication line.

Although embodiments of the present invention have been described and illustrated in detail, it is clearly understood that those are mere examples, and the scope of the present invention should not be limited to the examples in the descriptions and the appended claims.

What is claimed is:

1. An image forming apparatus comprising:

an image former which forms one or more images on a first initial sheet fed from a first feed tray of a plurality of feed trays and one or more images on a second initial sheet fed from a second feed tray of the plurality of feed trays;

a first adjuster which, based on positions of the one or more images formed on the first initial sheet by the image former, adjusts positions of one or more images to be formed by the image former on a first subsequent sheet fed from the first feed tray such that the positions of the one or more images to be formed on the first subsequent sheet match on both sides of the first subsequent sheet, and which, based on positions of the one or more images formed on the second initial sheet by the image former, adjusts positions of one or more images to be formed by the image former on a second subsequent sheet fed from the second feed tray such that the positions of the one or more images to be formed on the second subsequent sheet match on both sides of the second subsequent sheet; and a second adjuster which, based on the positions of the one or more images on the first initial sheet and the positions of the one or more images on the second initial sheet, further adjusts the positions of the one or more images to be formed by the image former on at least one of the first subsequent sheet and the second subsequent sheet, to reduce positional deviation between the one or more images to be formed by the image former on the first subsequent sheet and the one or more images to be formed by the image former on the second subsequent sheet.

2. The image forming apparatus of claim 1, wherein the second adjuster adjusts the positions of the one or more images to be formed on the at least one of the first and second subsequent sheets, to reduce positional deviation between the one or more images to be formed on the first and second subsequent sheets when the first and second subsequent sheets are respectively fed from the first and second feed trays and the positions of the first and second subsequent sheets on which the one or more images are formed are aligned.

3. The image forming apparatus of claim 1, wherein the image former forms reference images for position adjustment respectively on the first and second sheets fed from the feed trays, and the second adjuster adjusts the positions of the one or more images to be formed on the first and second subsequent sheets respectively fed from the first and second feed trays other than a reference tray selected from among the plurality of feed trays by a user to reduce positional deviation between the reference images on the first and second initial sheets respectively fed from the first and second feed trays other than the reference tray and reference images on reference sheets fed from the reference tray.

4. The image forming apparatus of claim 3, wherein the image former forms, together with the reference images respectively on the first initial sheet, the second initial sheet and the reference sheets, an identification image indicating which feed tray, among the plurality of feed trays, has fed the respective sheets on which the references image are formed.

5. The image forming apparatus of claim 3, further comprising:

an operation receiver, wherein the second adjuster adjusts the positions of the one or more images to be formed on the first and second subsequent sheets depending on a difference between measured values of the positions of the reference images on the first and second initial sheets and the reference sheets, the measured values being input from the operation receiver.

6. The image forming apparatus of claim 3, further comprising:

an image reader which reads each of surfaces of the first, second and reference sheets on which the reference images are formed to generate read image data, wherein the second adjuster detects the positions of the reference images in the read image data of the first, second and reference sheets generated by the image reader, and adjusts the positions of the one or more images to be formed on the first and second subsequent sheets depending on a difference of the positions of the reference images detected from the first, second and reference sheets.

7. The image forming apparatus of claim 1, wherein the second adjuster adjusts the positions of the one or more images to be formed on the first subsequent sheet before start of a job on the first subsequent sheet.

8. The image forming apparatus of claim 1, wherein the second adjuster adjusts the positions of the one or more images to be formed on the first subsequent sheet when at least one of the feed trays is refilled with the sheets.

9. The image forming apparatus of claim 1, wherein the second adjuster adjusts the positions of the one or more images to be formed on the first subsequent sheet, and adjusts the positions of the one or more images to be formed on the second subsequent sheet, when the one or more images to be formed on the first subsequent sheet and the one or more images to be formed on the second subsequent sheet are to be formed on same respective positions on the first and second subsequent sheets.

10. An image forming system comprising;

a plurality of feed trays including a first feed tray and a second feed tray;

an image former which forms one or more images on a first initial sheet fed from the first feed tray and one or more images on a second initial sheet fed from the second feed tray;

a first adjuster which, based on positions of the one or more images formed on the first initial sheet by the image former, adjusts positions of one or more images to be formed by the image former on a first subsequent sheet fed from the first feed tray such that the positions of the one or more images to be formed on the first subsequent sheet match on both sides of the first subsequent sheet, and which, based on positions of the one or more images formed on the second initial sheet by the image former, adjusts positions of one or more images to be formed by the image former on a second subsequent sheet fed from the second feed tray such that the positions of the one or more images to be formed on the second subsequent sheet match on both sides of the second subsequent sheet; and a second adjuster which, based on the positions of the one or more images on the first initial sheet and the positions of the one or more images on the second initial sheet, further adjusts the positions of the one or more images to be formed by the image former on at least one of the first subsequent sheet and the second subsequent sheet, to reduce positional deviation between the one or more images to be formed by the image former on the first subsequent sheet and the one or more images to be formed by the image former on the second subsequent sheet.

11. A computer readable recording medium storing a program which causes a computer to execute:

based on positions of one or more images formed on a first initial sheet fed from a first feed tray, adjusting positions of one or more images to be formed on a first subsequent sheet fed from the first feed tray such that the positions of the one or more images to be formed on the first subsequent sheet match on both sides of the first subsequent sheet;

based on positions of one or more images formed on a second initial sheet fed from a second feed tray, adjusting positions of one or more images to be formed on a second subsequent at least one sheet fed from the second feed tray such that the positions of the one or more images to be formed on the second subsequent sheet match on both sides of the second subsequent sheet; and based on the positions of the one or more images on the first initial sheet and the positions of the one or more images on the second initial sheet, further adjusting the positions of the one or more images to be formed on at least one of the first subsequent sheet and the second subsequent sheet, to reduce positional deviation between the one or more images to be formed by the image former on the first subsequent sheet and the one or more images to be formed by the image former on the second subsequent sheet.

* * * * *